US008893983B2

(12) United States Patent
Wang

(10) Patent No.: US 8,893,983 B2
(45) Date of Patent: Nov. 25, 2014

(54) IMPINGEMENT SPRINKLER WITH ADJUSTABLE OUTFLOW ANGLE

(75) Inventor: Cheng-An Wang, Chang Hua Hsien (TW)

(73) Assignee: Sunny Bird Enterprise Co., Ltd., Xianxi Township, Changhua County (TW)

( * ) Notice: Subject to any disclaimer, the term of this patent is extended or adjusted under 35 U.S.C. 154(b) by 344 days.

(21) Appl. No.: 13/586,285

(22) Filed: Aug. 15, 2012

(65) Prior Publication Data

US 2013/0270363 A1 Oct. 17, 2013

(30) Foreign Application Priority Data

Apr. 16, 2012 (TW) ..... 101206972 A

(51) Int. Cl.
*B05B 3/08* (2006.01)

(52) U.S. Cl.
USPC .. 239/222.13; 239/210; 239/230; 239/DIG. 1

(58) Field of Classification Search
USPC ..... 239/200, 210, 214, 222.11, 222.13, 239/222.15, 222.17, 587.1, 587.2, 587.5, 239/587.6, 225.1, 230–233, 273, 280
See application file for complete search history.

(56) References Cited

U.S. PATENT DOCUMENTS

| | | | | |
|---|---|---|---|---|
| 3,893,630 | A * | 7/1975 | Bochmann et al. | 239/587.5 |
| 4,720,883 | A * | 1/1988 | Sanchez | 15/4 |
| 6,511,001 | B1 * | 1/2003 | Huang | 239/526 |
| 6,595,439 | B1 * | 7/2003 | Chen | 239/225.1 |
| 6,976,644 | B2 * | 12/2005 | Troudt | 239/587.1 |
| 7,841,545 | B2 * | 11/2010 | Wang | 239/230 |
| 8,382,009 | B2 * | 2/2013 | Wang | 239/236 |
| 8,695,893 | B2 * | 4/2014 | Wang | 239/230 |

* cited by examiner

*Primary Examiner* — Justin Jonaitis
(74) *Attorney, Agent, or Firm* — Egbert Law Offices, PLLC

(57) ABSTRACT

An impingement sprinkler with adjustable outflow angle has a sprinkler main body, an impingement rotation guiding frame, a water source connecting portion and an adjustment rotating member, so that the main body can be rotated through the adjustment rotating member to adjust the water outflow angle. The adjustment rotating member has a vertical water flow guiding portion provided on top of the water source connecting portion. A rotating pivot joint portion is provided on one side of the vertical water flow guiding portion. A water outlet is opened on the outside of the rotating pivot joint portion. A rotation sleeving portion is provided on the coupling portion of the main body and can sleeve the rotating pivot joint portion. Inside the rotation sleeving portion, a water outflow pass is configured and is connected with the sprinkler main body head on one side of the main body.

6 Claims, 8 Drawing Sheets

IMPINGEMENT SPRINKLER WITH ADJUSTABLE OUTFLOW ANGLE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to an impingement sprinkler, and more particularly to an innovative one which can maintain stable and sufficient water outflow when the outflow angle is normal or adjusted.

2. Description of Related Art Including Information Disclosed Under 37 CFR 1.97 and 37 CFR 1.98.

In large-area crop growing or gardening applications, sprinklers are commonly used for irrigation to save labor and time. The structure of a conventional gardening sprinkler is mainly made up of a main body, a sprinkler head arranged on top of the main body and projecting forward, a rotation guiding frame and a water inflow tube connected to the lower side of the main body. After flowing into the main body through the water inflow tube, water can be sprayed out from the sprinkler head, and because of the forward projecting structure of the sprinkler head, the water flow can be sprinkled as a parabolic water column. Meanwhile, the water column will drive the rotation guiding frame to achieve an automatic rotary sprinkling action for irrigation purposes. However, in response to the diversified consumer demands, some manufacturers have developed sprinkles with adjustable water outflow angle. In the structure of such products, an adjustment rotating member is provided between the main body and the water inflow tube, so that the angle of the main body can be adjusted through the adjustment rotating member so as to change the parabolic angle of the water column.

However, in the structure of the prior-art sprinkler adjustment rotating member, usually a rotating seat is provided on the bottom of the main body, and a fixing seat is provided on the top of the water inflow tube, and a rotating mechanism is configured inside the rotating seat and fixing seat for rotation purpose. However, in order to let water flow smoothly through the rotating seat and fixing seat, most manufacturers will arrange a water guiding groove inside the fixing seat surrounding the rotating mechanism for the water flow to pass through, and arrange a water inlet inside the rotating seat for the water flow to go into the sprinkler head. As most of the space inside the rotating seat is occupied by the rotating mechanism, the water flow guiding groove can be too small, moreover, because of the structural configuration of the water flow guiding groove and the water inlet, the water flow must firstly go into the fixing seat, and then into the rotating seat through the water flow guiding groove, and finally into the water inlet. Very likely, such design may cause shortcomings of insufficiency and instability of the water outflow. And after a long period of usage, impurities or other pollutants in the water may cause blocking of the water flow guiding groove. At present, there have been attempts by manufacturers to change the structural form of the adjustment rotating member, but none of the new developments can change the outflow angle while providing stable and sufficient water outflow. Therefore, users are expecting development of an improved structural design of an impingement sprinkler and manufacturers shall make effort to realize it.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

The present invention discloses "an impingement sprinkler with adjustable outflow angle" with the unique design of an adjustment rotating member which enables adjustment of the outflow angle while maintaining stable and sufficient outflow. With such an innovative and unique design, the present invention is superior to the structure disclosed in prior art. Through the vertical water flow guiding portion of the adjustment rotating member, and the water outlet and water outflow pass, the water flow can directly go from the vertical water flow guiding portion through the rotating pivot joint portion and water outlet into the water outflow pass provided on the rotation sleeving portion, and when the angle of the sprinkler main body is adjusted by rotation, the water outlet and water outflow pass can maintain aligned, so that stable and sufficient water outflow can be maintained either in the normal state or when the outflow angle is adjusted. Therefore, the irrigation effect and quality, as well as convenience of usage can be enhanced.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
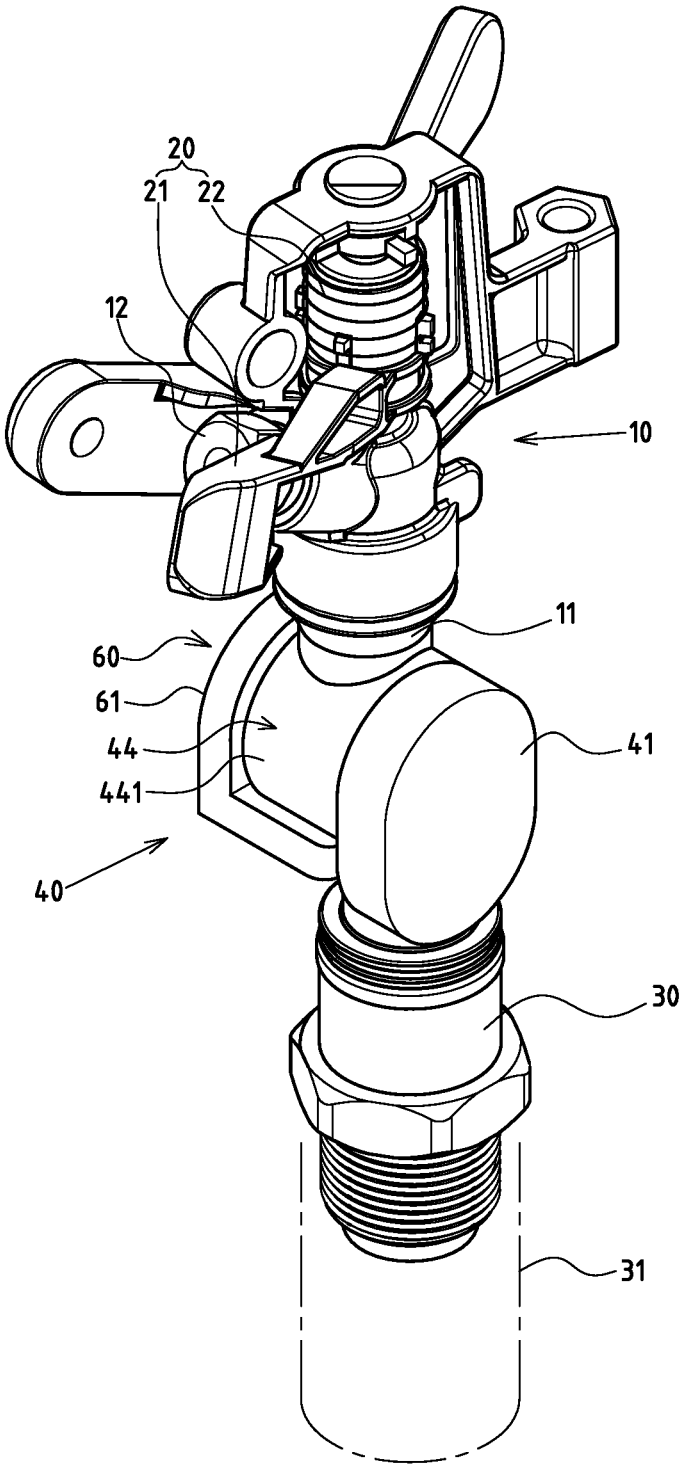
FIG. 1 shows an assembled perspective view of the structure of the present invention.

FIGS. 1 to 4 depict a preferred embodiment of the impingement sprinkler with adjustable outflow angle of the present invention. However, such an embodiment is illustrative only and shall not intend to limit the scope of patent claims.

Said impingement sprinkler with adjustable outflow angle comprises a sprinkler main body 10, including a coupling portion 11 formed on one side of the sprinkler main body 10. On one side of the sprinkler main body 10, there is a sprinkler head 12 projecting forward.

An impingement rotation guiding frame 20 is movably arranged on the top of the sprinkler main body 10. On one side of the impingement rotation guiding frame 20, there is a water pushing portion 21 and a torsional spring 22. The water pushing portion 21 is separated from but aligned to the front end of the sprinkler head 12 of the sprinkler main body 10. Water flow sprayed out from the sprinkler head 12 can push the water pushing portion 21 to swing outward, then, through the elastic reset force of the torsional spring 22, the water pushing portion 21 can reciprocate.

A water source connecting portion 30 is provided on the lower side of the coupling portion 11, to connect with the water source portion 31 (here, the water source portion 31 is a water tube).

Figure 3:
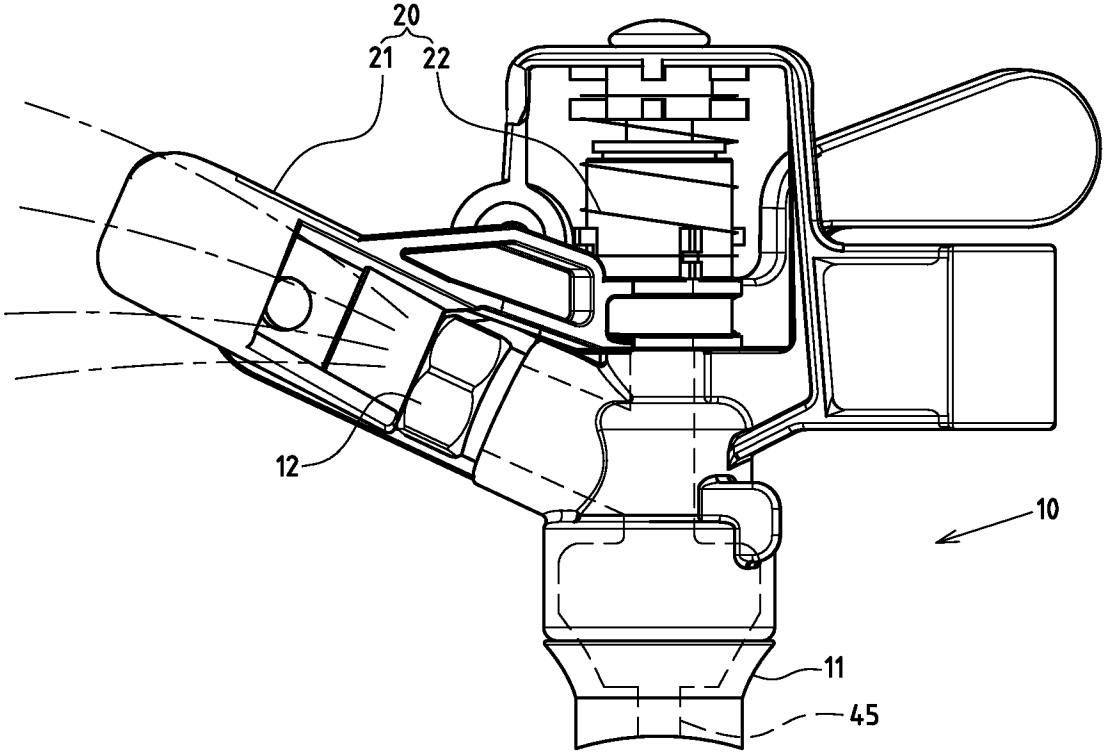
FIG. 3 shows a plane schematic view of inner structure of the present invention with water sprinkled from the sprinkler head.
Figure 4:
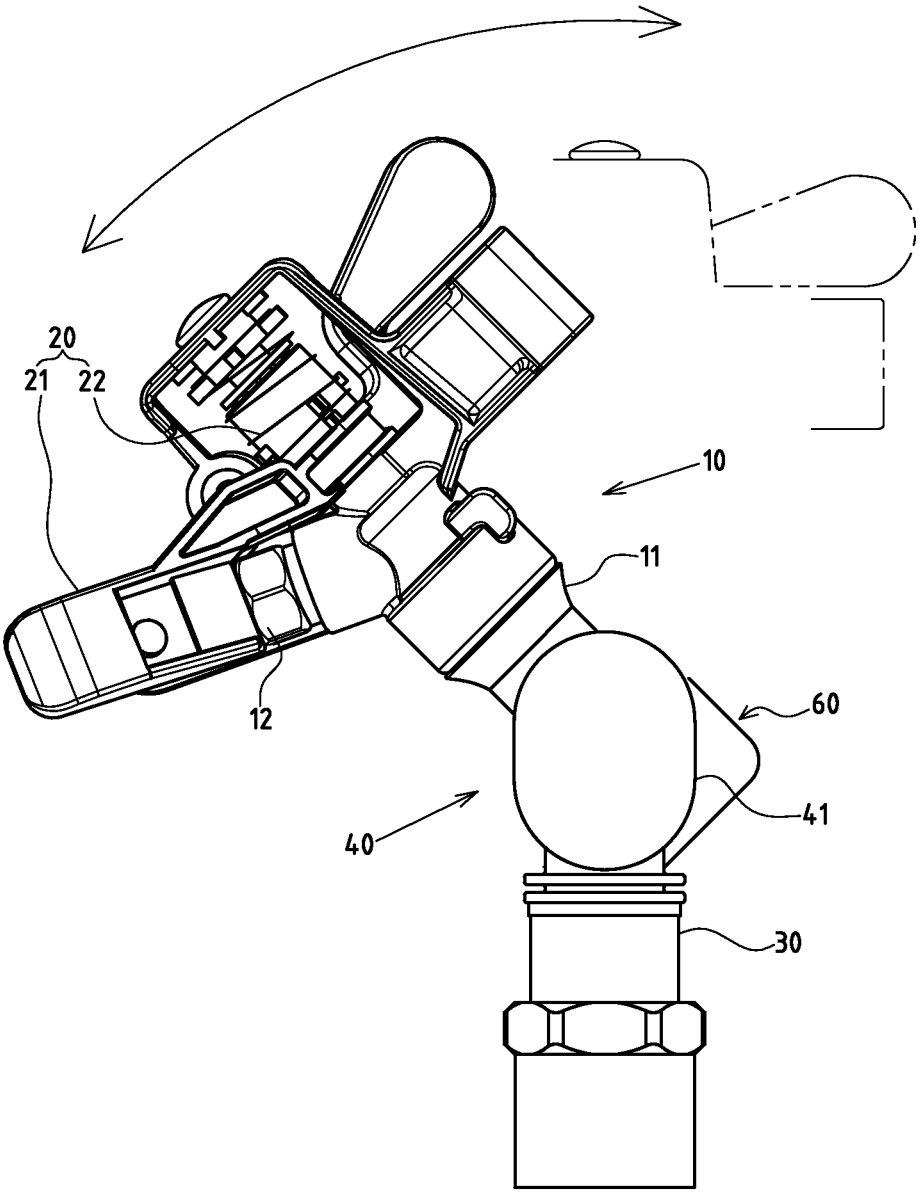
FIG. 4 shows a schematic view of operation to adjust the rotation angle of the present invention.
Figure 5:
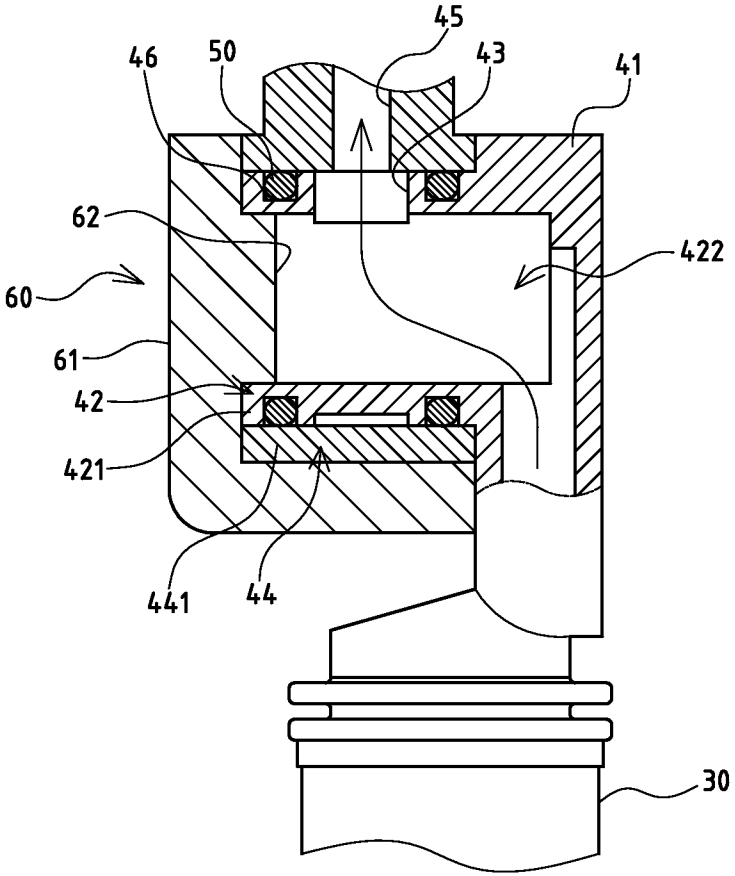
FIG. 5 shows a sectional view of the inner structure of the adjustment rotating member of the present invention and the water flow state.

An adjustment rotating member 40 is hinged between the coupling portion 11 and water source connecting portion 30 of the sprinkler main body 10, so that the sprinkler main body 10 can be rotated through the adjustment rotating member 40 to obtain an expected water outflow angle (see FIGS. 3 and 4).

The adjustment rotating member 40 comprises a vertical water flow guiding portion 4, being a hollow enclosure provided on top of the water source connecting portion 30; a rotating pivot joint portion 42, provided on one side of the vertical water flow guiding portion 41 in a projecting form, and the inside of the rotating pivot joint portion 42 is hollow and connected with the vertical water flow guiding portion 41, a water outlet 43, opened on the outside of the rotating pivot joint portion 42. In the present embodiment, the water outlet 43 is in a rectangular form. A rotation sleeving portion 44 is provided on the coupling portion 11 of the sprinkler main body 10. Inside the rotation sleeving portion 44, a water outflow pass 45 is configured. The water outflow pass 45 is connected with the inside of the sprinkler main body 10 and the sprinkler head 12, and the rotation sleeving portion 44 can sleeve the rotating pivot joint portion 42, and the water outflow pass 45 is aligned to the water outlet 43. A water stopping portion 60 is provided for sealing on the side of the rotating pivot joint portion 42, to prevent water from leaking.

In this way, with configurations of vertical water flow guiding portion 41, water outlet 43, and water outflow pass 45 of the adjustment rotating member 40, when the sprinkler main body 10 is rotated for angle adjustment, the water outlet 43 of the rotating pivot joint portion 42 can be aligned to the water outflow pass 45 of the rotation sleeving portion 44, so that stable and sufficient water outflow can be maintained at the normal or adjusted water outflow angles and irrigation effect can be enhanced.

Figure 2:
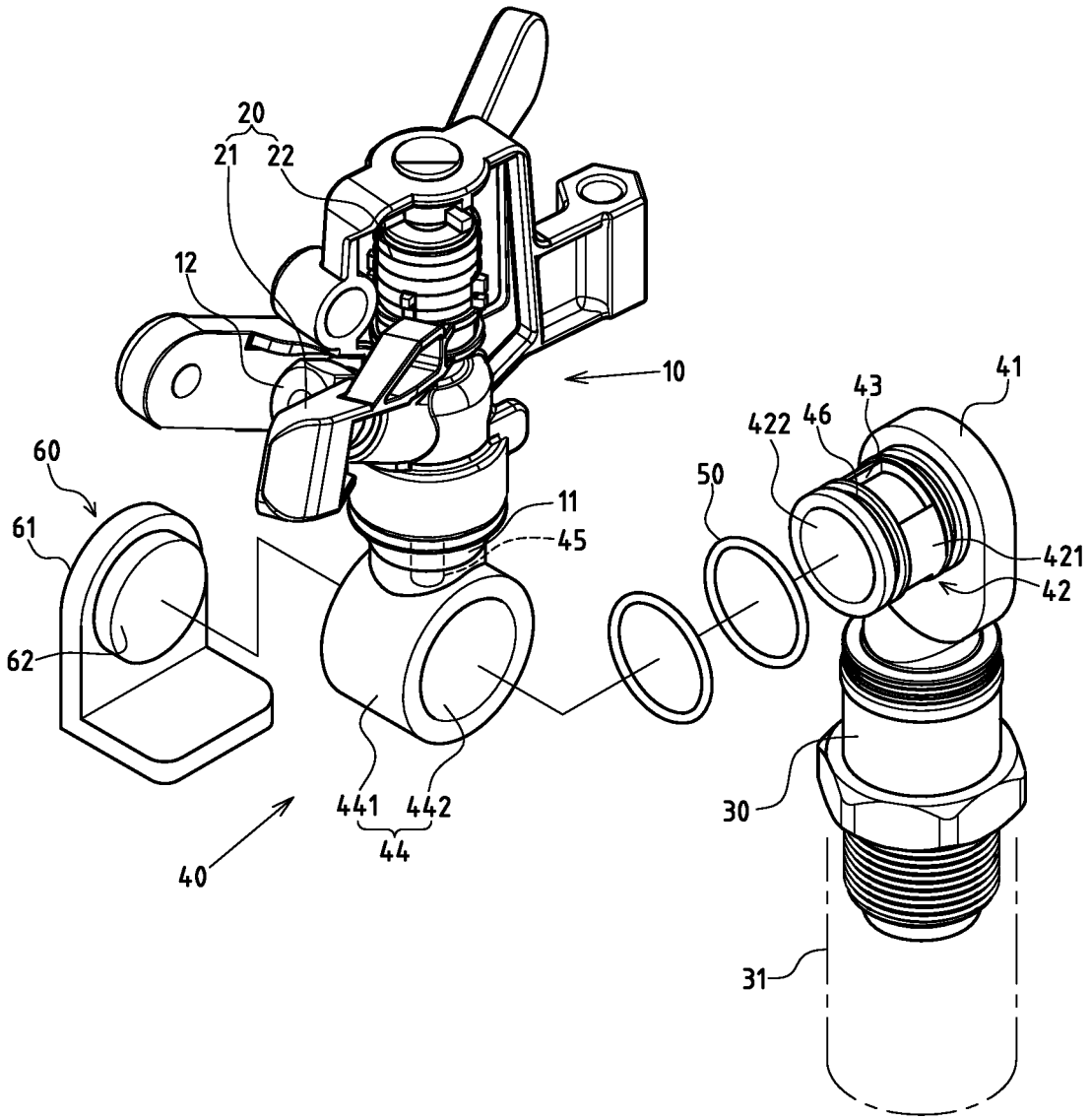
FIG. 2 shows an exploded perspective view of the structure of the present invention.

The features and the advantages of the present invention will be more readily understood upon a thoughtful deliberation of the following detailed description of the structure of the above-stated adjustment rotating member 40 (see FIGS. 1 and 2).

Wherein, the rotating pivot joint portion 42 is in a projecting form and forms a male connector 421 and a perforation 422 inside the male connector 421, the water outlet 43 is configured on the outside of the male connector 421, and the opposite sides of the water outlet 43 of the male connector 421 are configured with limiting caulking grooves 46 for fitting two water-stop rings 50. The water-stop rings 50 can be two O-rings of the same specification or different specifications, in the present embodiment, they are made of O-rings of the same specification.

Wherein, when increasing the rotating adjustment angle of the sprinkler main body 10, the water outlet 43 and water outflow pass 45 can be misaligned, so that the water outflow can adjusted. The detailed operating state will be described later.

In addition, the rotation sleeving portion 44 includes a sleeving seat 441 and a sleeving perforation 442 formed inside the sleeving seat 441. The sleeving perforation 442 can match and sleeve onto the male connector 421 of the rotating pivot joint portion 42, to achieve a movable state of the rotation sleeving portion 44 (just like the match between an axle and an axle hole), and consequently, the sprinkler main body 10 can be rotated.

Wherein, the water stopping portion 60 on the side of the rotating pivot joint portion 42 disclosed by the present invention can be implemented in a cylindrical form to cover and seal the perforation 422 of the male connector 421 provided on the rotating pivot joint portion 42, so as to prevent water leaking. Moreover, one side of the male connector 421 of the rotating pivot joint portion 42 can be configured in the form of an elastic flange, so that when the sleeving perforation 442 of the sleeving seat 441 sleeves onto the male connector 421, it can be elastically held and limited, and consequently the sleeving state of the rotation sleeving portion 44 can be limited (not shown in the embodiment drawing).

Referring to FIGS. 1 and 2 showing another embodiment of the water stopping portion 60, the water stopping portion 60 comprises an end cap 61 and a pivot head 62 configured on one side of the end cap 60. The pivot head 62 can fit into the perforation 422 of the male connector 421, and the end cap 61 can resist against the side of the sleeving seat 441. In such an embodiment, the water stopping portion 60 can not only prevent water leaking, but also limit the sleeving state of the rotation sleeving portion 44. And wherein, the sealing state between the water stopping portion 60 and the rotating pivot joint portion 42 can be achieved by any of ultrasonic welding, glue or clasp. Ultrasonic welding is preferred in the present embodiment, but there may be other alternatives.

Figure 6:
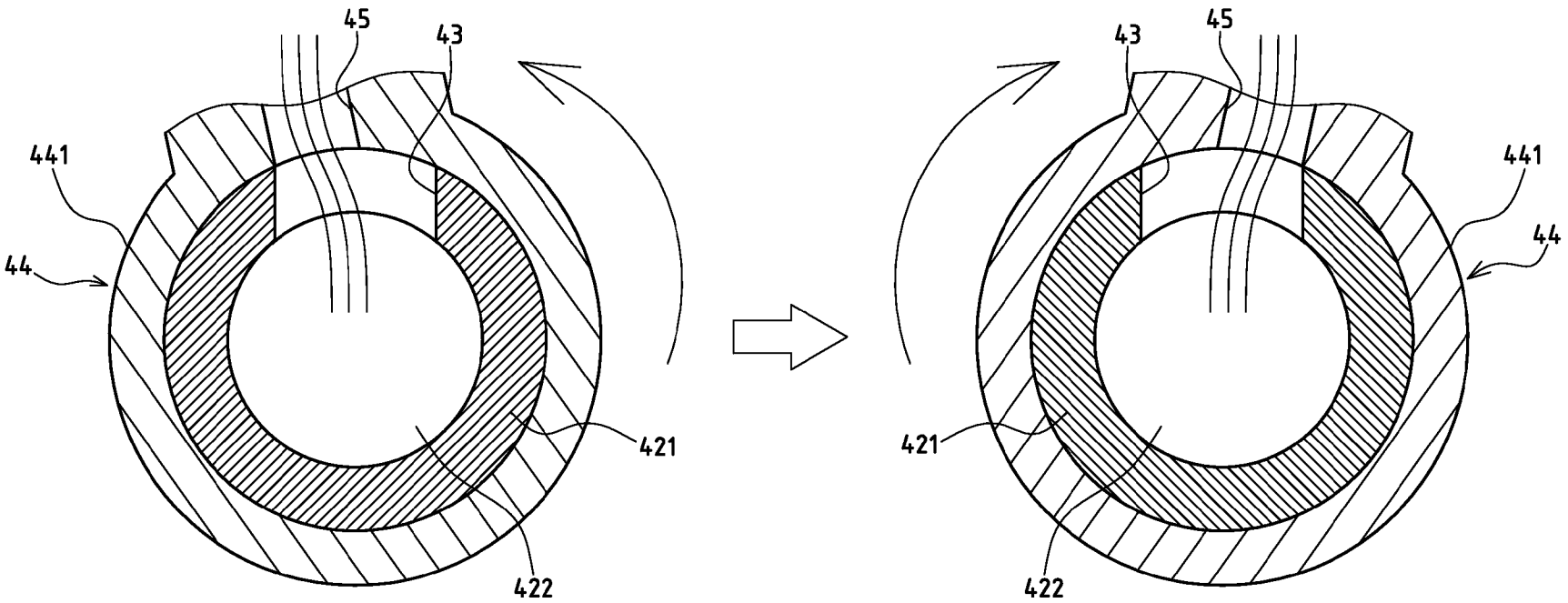
FIG. 6 shows a schematic view of the operating state of the present invention when the water outflow pass is aligned to the water outlet.

The above structures constitute the construction of the present invention. Operation of the present invention is detailed below:

Referring to FIGS. 2 to 6, the sprinkler main body 10 of the present invention can be rotated to any angle through the adjustment rotating member 40. When the sprinkler main body 10 is at the normal position and not rotated, the water outlet 43 configured on the rotating pivot joint portion 42 of the adjustment rotating member 40 is aligned to the water outflow pass 45 configured on the rotation sleeving portion 44 (shown in FIGS. 2 and 5), so that the water flow can go through the vertical water flow guiding portion 41 into the rotating pivot joint portion 42, then from the water outlet 43 to the water outflow pass 45, and finally be sprayed out from the sprinkler head 12, to maintain sufficient water flow. When it is needed to sprinkle farther or nearer crops, the user can rotate the sprinkler main body 10 to obtain a larger or smaller oblique angle and achieve different parabolic distances of the water flow sprayed out from the sprinkler head 12. And while rotating the sprinkler main body 10, the water outlet 43 and water outflow pass 45 can still maintain the aligned state (as shown in FIG. 6), and the water flow is still stable and sufficient. Therefore, stable and sufficient water flow can be maintained either in the normal position or at adjusted outflow angles.

Figure 7:
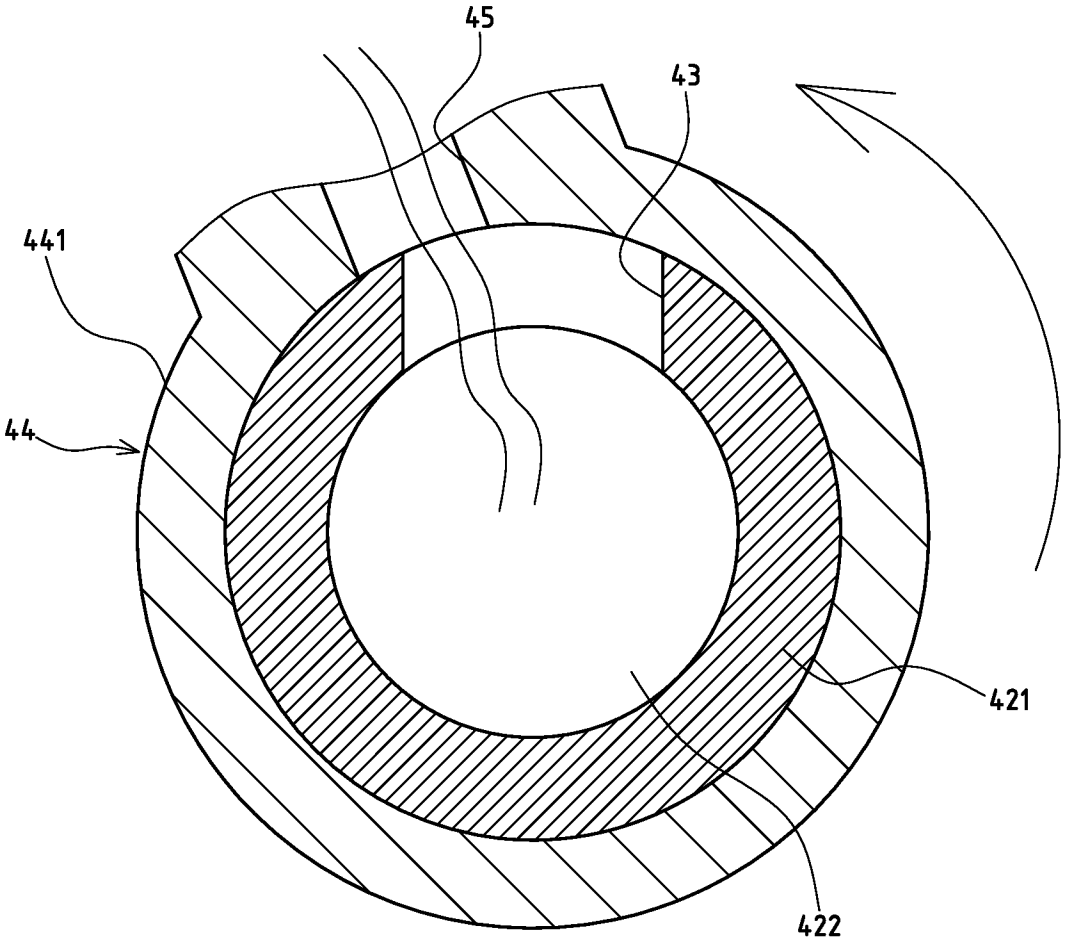
FIG. 7 shows a schematic view of the operating state of the present invention when the water outflow pass is not aligned to the water outlet.

Referring to FIG. 7 showing another embodiment of action state of the present invention, by adjusting the rotation angle of the sprinkler main body 10, the water outlet 43 and water outflow pass 45 can be misaligned, i.e., when increasing the adjustment angle, the water outlet 43 and water outflow pass 45 are misaligned and the space for water to pass becomes narrower (by rotating to the left as an example in this embodiment, while it can be achieved similarly by rotating to the right), and consequently the amount of water flow is changed. In this way, the user can adjust the outflow angle to change the amount of water flow to meet the different requirements of different crops. Therefore, the convenience of operation is enhanced.

Figure 8:
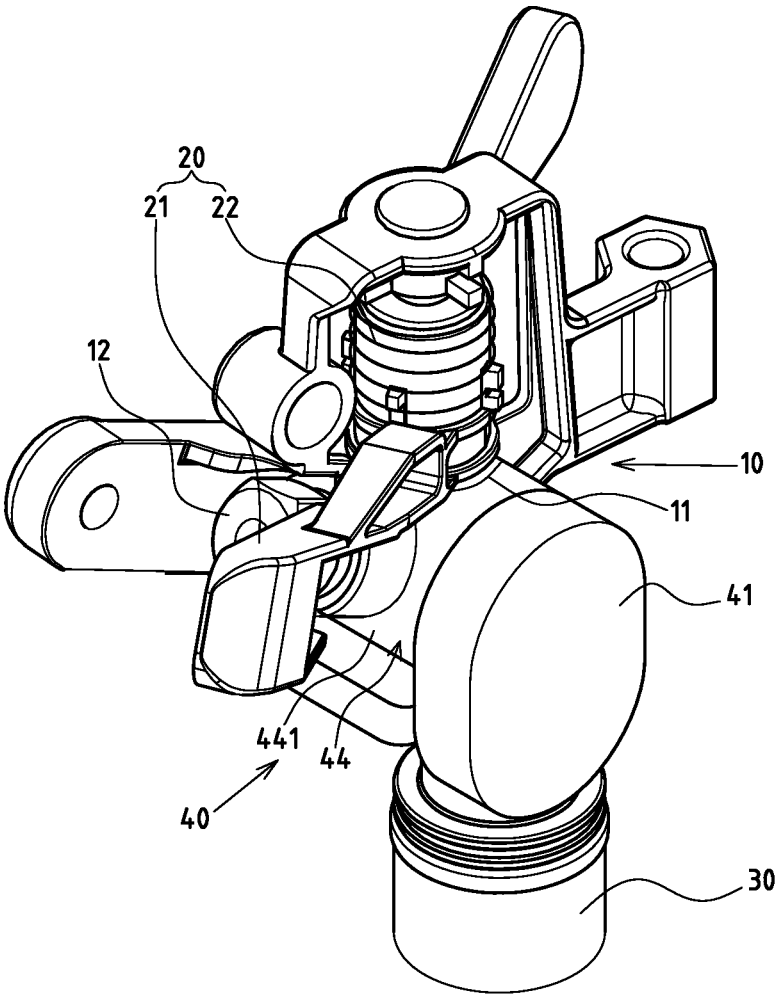
FIG. 8 shows an assembled perspective view of another embodiment of the present invention.

FIG. 8 shows another possible embodiment of the present invention, i.e., the section between the coupling portion 11 of the sprinkler main body 10 and rotation sleeving portion 44 is removed, and the sprinkler head 12 is directly formed on the outside of the rotation sleeving portion 44, so that water flow can go through the water outlet 43 and water outflow pass 45, and be directly sprayed out from the sprinkler head 12. In this way, stability and sufficiency of water outflow can be effectively enhanced.

I claim:

1. An impingement sprinkler with adjustable outflow angle, comprising:

a sprinkler main body, including a coupling portion formed on one side of the sprinkler main body, and on one side of the sprinkler main body, there is a sprinkler head projecting forward;

an impingement rotation guiding frame, movably arranged on the top of the sprinkler main body; on one side of the impingement rotation guiding frame, there is a water pushing portion and a torsional spring; the water pushing portion is separated from but aligned to the front end of the sprinkler head of the sprinkler main body;

a water source connecting portion, provided on the lower side of the coupling portion, to connect with the water source portion;

an adjustment rotating member, hinged between the coupling portion and water source connecting portion of the sprinkler main body, so that the sprinkler main body can be rotated through the adjustment rotating member to adjust the outflow angle, and the adjustment rotating member comprises:

a vertical water flow guiding portion, being a hollow enclosure provided on top of the water source connecting portion; a rotating pivot joint portion, provided on one side of the vertical water flow guiding portion in a projecting form, and the inside of the rotating pivot joint portion is hollow and connected with the vertical water flow guiding portion; a water outlet, opened on the outside of the rotating pivot joint portion; a rotation sleeving portion, provided on the coupling portion of the sprinkler main body; inside the rotation sleeving portion, a water outflow pass is configured; the water outflow pass is connected with the inside of the sprinkler main body and the sprinkler head, and the rotation sleeving portion can sleeve the rotating pivot joint portion, and the water outflow pass is aligned to the water outlet; a water stopping portion, sealing on the side of the rotating pivot joint portion, to prevent water from leaking; In this way, with configurations of the vertical water flow guiding portion, water outlet, and water outflow pass of the adjustment rotating member, stable and sufficient water outflow can be maintained to enhance the irrigation effect.

2. The device defined in claim 1, wherein the rotating pivot joint portion is in a projecting form and forms a male connector and a perforation inside the male connector, the water outlet is configured on the outside of the male connector, and the opposite sides of the water outlet of the male connector are configured with limiting caulking groove for fitting two water-stop rings; and wherein, the rotation sleeving portion includes a sleeving seat and a sleeving perforation formed inside the sleeving seat, the sleeving perforation can match and sleeve onto the male connector of the rotating pivot joint portion.

3. The device defined in claim 2, wherein the water-stop rings can be two O-rings of the same specification or different specifications.

4. The device defined in claim 1, wherein, by adjusting the rotation angle of the sprinkler main body, the water outlet and water outflow pass can be misaligned, so that the water outflow quantity can be changed.

5. The device defined in claim 1, wherein the water stopping portion comprises an end cap and a pivot head configured on one side of the end cap; the pivot head can fit into the perforation of the male connector of the rotating pivot joint portion, and the end cap can resist against the side of the sleeving seat, so as to limit the sleeving state of the rotation sleeving portion.

6. The device defined in claim 5, wherein the sealing state between the water stopping portion and the rotating pivot joint portion can be achieved by any of ultrasonic welding, glue or clasp.

* * * * *